US006747562B2

(12) United States Patent
Giraldin et al.

(10) Patent No.: US 6,747,562 B2
(45) **Date of Patent: *Jun. 8, 2004**

(54) IDENTIFICATION TAG FOR REAL-TIME LOCATION OF PEOPLE

(75) Inventors: Patrick W. Giraldin, Irvine, CA (US); Regan E. Kelly, Laguna Niguel, CA (US); Timothy W. Giraldin, Aliso Viejo, CA (US)

(73) Assignee: SafeTzone Technologies Corporation, Laguna Hills, CA (US)

( * ) Notice: Subject to any disclaimer, the term of this patent is extended or adjusted under 35 U.S.C. 154(b) by 39 days.

This patent is subject to a terminal disclaimer.

(21) Appl. No.: 09/992,872

(22) Filed: Nov. 13, 2001

(65) Prior Publication Data

US 2003/0090386 A1 May 15, 2003

(51) Int. Cl.[7] ..... G08B 23/00
(52) U.S. Cl. ..... 340/573.1; 340/574; 340/825.49
(58) Field of Search ..... 340/573.1, 574, 340/573.4, 825.49, 995, 998, 990

(56) References Cited

U.S. PATENT DOCUMENTS 4,275,385 A * 6/1981 White ..... 340/825.49
4,495,496 A * 1/1985 Miller, III ..... 340/10.2
4,998,095 A * 3/1991 Shields ..... 340/574
5,933,079 A * 8/1999 Frink ..... 340/539
5,977,877 A * 11/1999 McCulloch et al. ..... 340/572.8
5,987,421 A 11/1999 Chuang ..... 705/7
6,057,756 A * 5/2000 Engellenner ..... 340/505
6,150,921 A * 11/2000 Werb et al. ..... 340/10.1
6,424,264 B1 * 7/2002 Giraldin et al. ..... 340/573.1

FOREIGN PATENT DOCUMENTS

JP 10090387 A 9/1996
JP 2000111648 A 4/2000

* cited by examiner

*Primary Examiner*—John Tweel
(74) *Attorney, Agent, or Firm*—Duckor Spradling & Metzger; Bernard L. Kleinke

(57) ABSTRACT

A locator system for tracking the location of individuals in a defined environment is disclosed. The system comprises at least one user identifier, at least one reader, at least one locator station and an identification server. The user identifier includes a long-range transmitter adapted to transmit an identification signal and a short-range passive component having identification information. The reader is adapted to receive the identification signal from the long-range transmitter. The locator station is adapted to read the identification information from the short-range passive component. The identification server is adapted to communicate with the reader and the locator, and has a database associating the identification signal of the long-range transmitter and the identification information of the short-range passive component with a particular user. The identification signal from the long-range transmitter may be an intermittent chirp. The long-range transmitter and the short-range passive component may be mounted on an identification tag, which may be attached to a wrist strap for securing the identification tag to a user's wrist.

12 Claims, 3 Drawing Sheets

IDENTIFICATION TAG FOR REAL-TIME LOCATION OF PEOPLE

RELATED APPLICATIONS

The following application is related to the present invention and is hereby incorporated by reference in its entirety: U.S. patent application, Ser. No. 09/992,668, titled "SYSTEM FOR REAL-TIME LOCATION OF PEOPLE IN A FIXED ENVIRONMENT," filed concurrently herewith.

BACKGROUND OF THE INVENTION

1. Field of the Invention

The present invention relates generally to tracking systems, and more specifically to identification tags for tracking and locating individuals of a group within a defined environment such as a theme park or other such fixed activity environment.

2. Related Art

Systems and equipment necessary for tracking a group of individuals in real-time within a defined environment such as a theme park provide several challenges. The system should be able to distinguish every individual in the park and separately track their movement continuously or as needed within the environment and ideally should be able to locate members of the group within seconds of separation if either becomes lost or separated. For this purpose, the system should provide convenient access anywhere within the environment no matter how large and should operate effectively regardless of the extent of crowding. The system also should be accurate and provide updates on location every 7–15 seconds as desired. This is particularly important in tracking fast moving children who become separated from their parents.

Systems and equipment for tracking the location of moving objects such as people in real time have been described (see, e.g., U.S. Pat. Nos. 5,764,283 and 5,973,732), however, the inventor is not aware of any description that satisfies the requirements discussed above. Many prior systems are based on tracking by comparing video frames taken at different times. A video directed approach, however, is suited only for tracking individuals in a very limited space such as the threshold of a store. Systems that use a tagging device attached to the individual for communication via radio frequency transmission and receipt also have been described, however, such devices are used primarily for controlling portal entry to a secured area.

Thus, it would be useful to have a system and equipment for tracking individuals of a group in real time within a confined environment and to provide information to any of the group members as to the whereabouts of the other members of the group. Such system would be advantageous particularly in large areas such as theme parks, casinos, and the like.

BRIEF DESCRIPTION OF THE DRAWINGS

In the following, the invention will be explained in further detail with reference to the drawings, in which.

DESCRIPTION OF CERTAIN EMBODIMENTS OF THE INVENTION

U.S. patent application Ser. No. 09/687,062, filed Oct. 12, 2000, now U.S. Pat. No. 6,424,264B1, incorporated herein by reference in its entirety, discloses a system for real-time location of people in a fixed environment. One embodiment of the present invention provides an identification tag for use with such a system.

Figure 1:
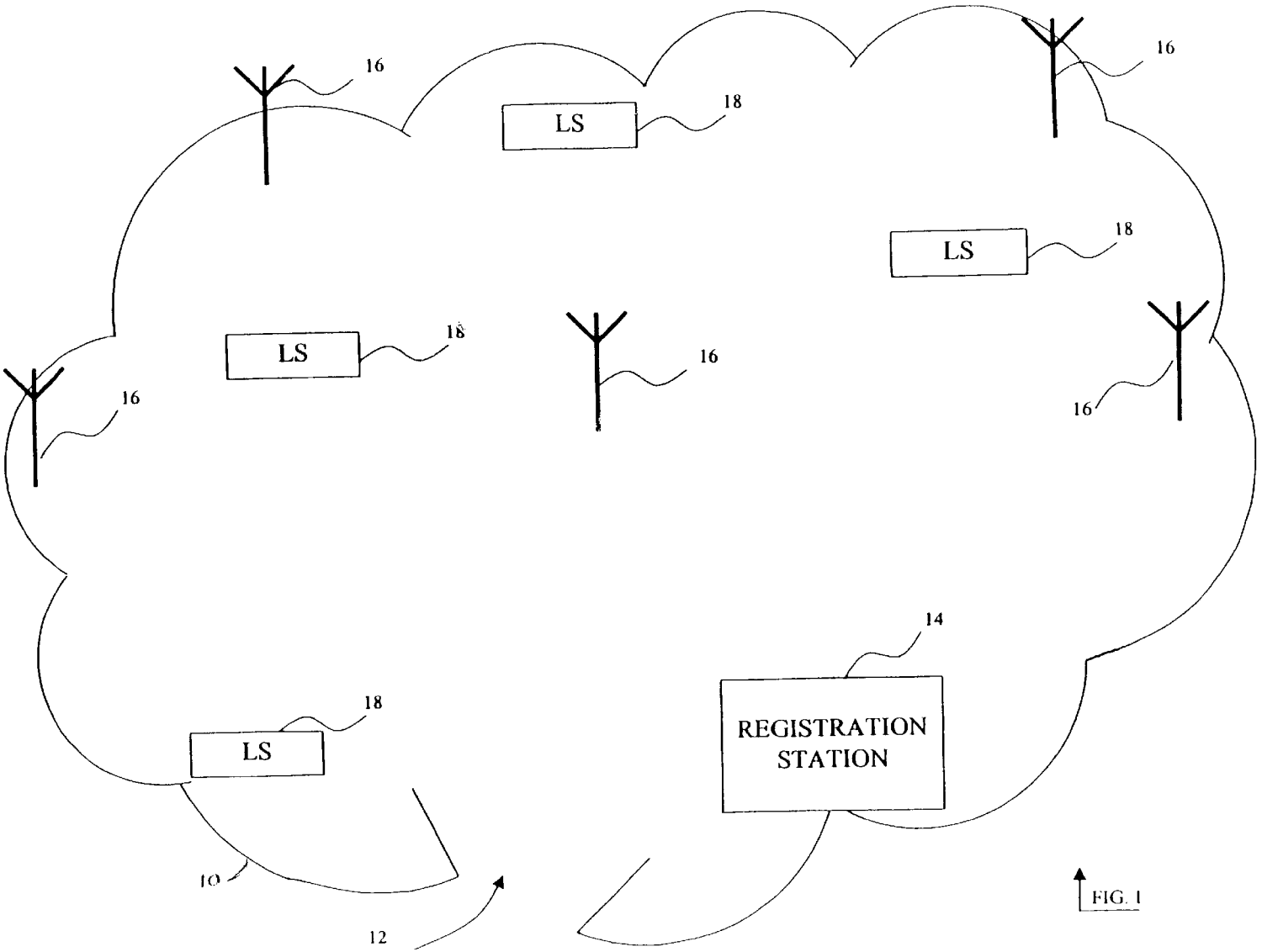
FIG. 1 is a pictorial illustration of a closed environment implementing an embodiment of the present invention.

FIG. 1 illustrates a closed environment in which an embodiment of the invention may be implemented. The closed environment 10 may be an area such as an amusement park or a cruise ship. An entrance 12 to the closed environment 10 is provided with a registration station 14 at which users of a location system may register. The registration system 14 may comprise one or more input terminals through which the names of the users, for example, may be input into the system, and one or more servers to store and provide the information as requested.

Throughout the closed environment 10, stationary readers 16 may be installed for receiving signals from identification tags issued to users. Identification tags according to the present invention are described below in further detail with reference to FIGS. 2 and 3. The readers 16 may be strategically placed throughout the closed environment 10 so that coverage is provided to every location in the environment 10. The readers 16 may take the form of any conventional antennas or receivers.

One or more locator stations 18 may be provided throughout the amusement park as well. The locator stations 18 serve to provide the users access to the information regarding the location of other users, as described below in detail. The locator stations 18 comprise at least one terminal through which a user may interface with a location system.

Figure 2:
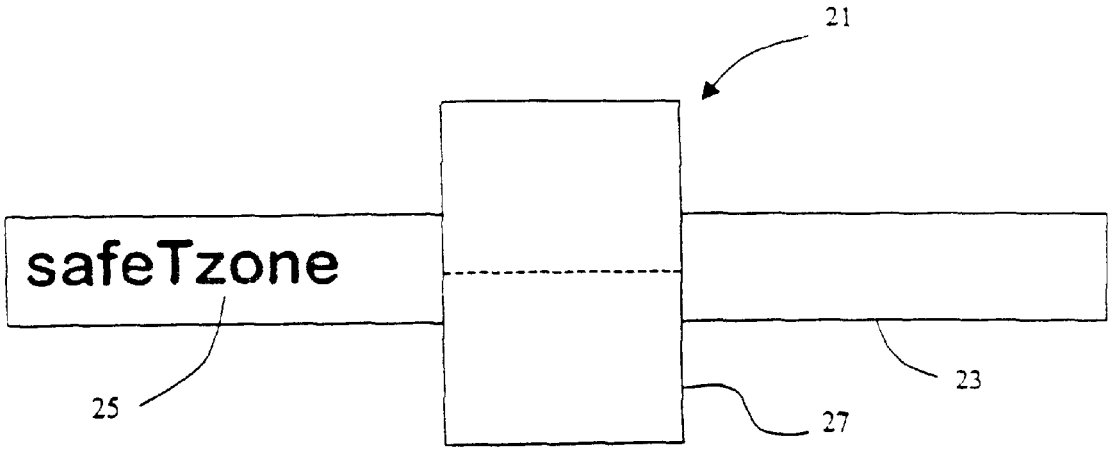
FIG. 2 is pictorial illustration of a wrist identification band according to one embodiment of the invention.

FIG. 2 illustrates a user identifier according to one embodiment of the invention. A wrist identification band 21 is illustrated to be worn by a user on his/her wrist similar to a wrist watch. The wrist identification band 21 comprises a strap 23 for securing the wrist identification band 21 to the user. A logo or indicia 25 may be provided on the wrist strap to identify the name of the amusement park or cruise ship, for example, or to provide advertisement space. The wrist identification band 21 also comprises an identification tag 27 for communication with an identification system. The identification tag 27 is described in further detail below and is more clearly illustrated in FIG. 3.

Figure 3:
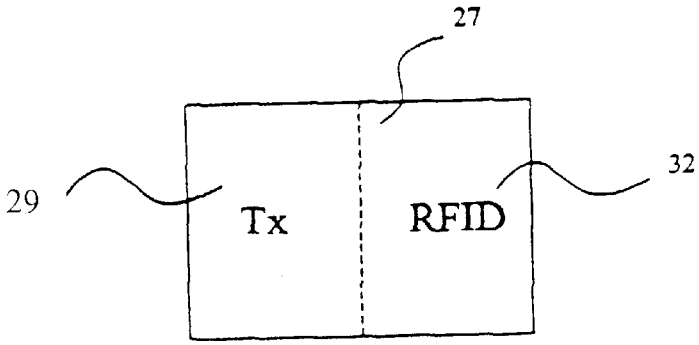
FIG. 3 is a pictorial illustration of an identification tag according to an embodiment of the invention.

As illustrated in FIG. 3, the identification tag 27 comprises at least two components. The first component is a long-range transmitter 29 for allowing communication between the identification tag 27 and the readers 16 illustrated in FIG. 1. The long-range transmitter 29 is configured to transmit a signal identifying the tag and/or the user wearing the tag. The long-range transmitter 29 may be, for example, a model produced by RF Code, Inc., of Phoenix, Ariz., Model # 05101297-06. The range of the long-range transmitter may be customized for particular uses. Preferably, the long-range transmitter has a range of 200–250 feet for use in most amusement parks or cruise ships.

In one embodiment, the long range transmitter 29 transmits a chirp every 7.5 seconds. The chirp may be unique to each individual identification tag 27 and, therefore, unique to each individual user. Thus, an identification system installed in a closed area such as an amusement park is provided with a signal from each individual user every 7.5 seconds. It is noted that the various identification tags 27 are not required to transmit a chirp simultaneously. The chirp signal is used by the system not only to identify the user, but also to pinpoint the user's location within the closed environment 10. This may be accomplished in several ways including triangulation from two readers 16.

Again referring to FIG. 3, the identification tag 27 also comprises a short-range passive component 32. As the name implies, the passive component 32 does not transmit a signal on a regular basis. Rather, information from the short-range passive component 32 may be read by another device. Information in the passive component 32 identifies the identification tag 27 as well as the user, similar to the information transmitted in the chirp by the long-range transmitter 29 described above. This information may be identical to that associated with the long-range transmitter 29 or may be different. If different, the location system associates the information with the user and/or the identification tag 27. In one embodiment, the short-range passive component 32 is an RFID Texas Instruments Model Number RI-TRP-REPH-ø ø.

The short-range passive component 32 offers immediate information to the user. Rather than waiting 7.5 seconds for the user's long-range transmitter to transmit a chirp, for example, the short-range passive component 32 may provide immediate identification to a locator system, as described below in greater detail.

Figure 4:
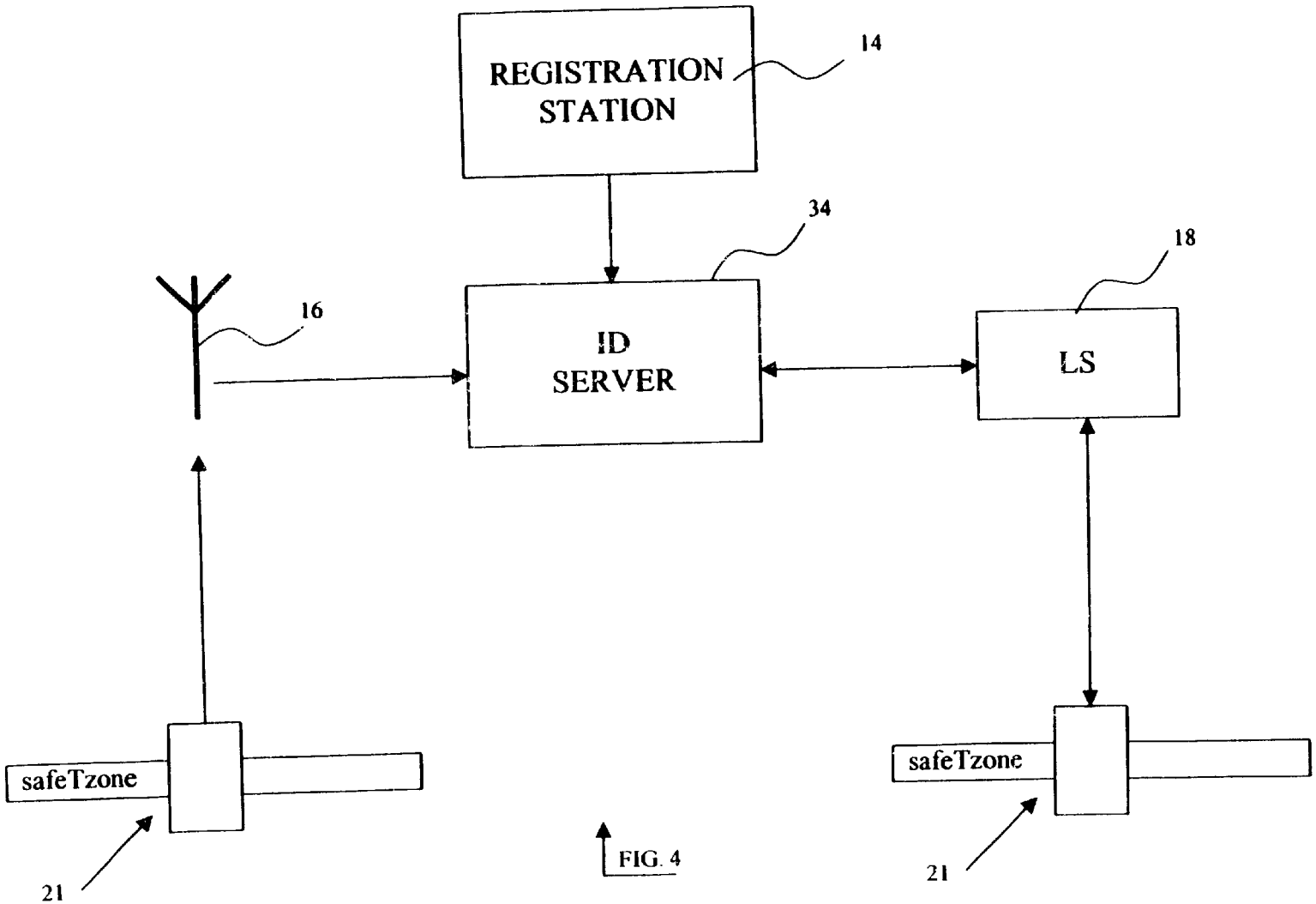
FIG. 4 is a schematic illustration of a system according to an embodiment of the present invention.

FIG. 4 illustrates the communication paths between the different components of an identification system. The registration station 14 described above in FIG. 1 communicates with an identification server 34. When an individual or a group of individuals enters the closed environment 10, wrist identification bands 21 are issued to each individual. Information relating to the issued wrist identification bands 21 and the individual is input into the registration station 14. This information is supplied to the identification server 34. The information may identify the group of individuals by a selected designation such as a group name or number. Thus, the identification server 34 is provided with data which includes a group comprising the individuals and the wrist identification bands 21 issued to those individuals.

As the individuals move through the closed environment 10, the long-range transmitters 29 in the wrist identification bands 21 transmit chirps regularly, such as every 7.5 seconds. The chirps are read by the readers 16 placed throughout the closed environment 10. The readers 16 transmit information relating to the chirps to the identification server 34, and the identification server 34 determines the location of the user based on that information. Alternatively, the readers 16 may be provided with software to determine the location based on the chirp and provide only the location to the identification server 34. Thus, the identification server 34 is provided with information relating to the location of each wrist identification band 21 and, therefore, the user wearing it.

When an individual user desires to locate other members of his/her group, he/she may use a locator station 18 to acquire the desired information. At the locator station 18, the user may present the wrist identification band 21 to a locator terminal. The locator terminal of the locator station 18 may communicate with the short-range passive component 32 to obtain the information on the particular wrist identification band 21 worn by the user. The communication between the terminal and the short-range passive component 32 may be accomplished in several ways. In a preferred embodiment, a signal from the locator terminal causes the short range passive component 32 to transmit a signal identifying the particular wrist identification band 21.

Once the locator terminal of the locator station 18 has obtained the information from the short-range passive component 32, the locator station 18 communicates with the identification server 34 to obtain information identifying the group to which the individual belongs. Additionally, the identification server 34 may access the last known position of each number of the group obtained through the chirps from the individual group members long-range transmitters 29. Thus, the locator station 18 may be provided with the locations of each member of the user group. This information may be provided to the user in several ways. In a preferred embodiment, the locator station 18 has a display which includes a map of the amusement park 10 on which the locations of the individual groups members may be displayed. The information displayed to the user may be updated as the identification server 34 receives updated locations of the other members of the group through the reception of chirps by the readers 16.

While particular embodiments of the present invention have been disclosed, it is to be understood that various different modifications and combinations are possible and are contemplated within the true spirit and scope of the appended claims. There is no intention, therefore, of limitations to the exact abstract or disclosure herein presented.

What is claimed is:

1. A user identifier for communication with a locator system in a defined environment, comprising:

a long-range transmitter adapted to transmit an identification signal to one or more readers in said defined environment, said identification signal being associated with a particular user; and a short-range passive component having identification information adapted to be read by a locator station.

2. The user identifier according to claim 1, wherein said identification signal is an intermittent chirp.

3. The user identifier according to claim 1, wherein said identification signal includes user information identifying said user.

4. The user identifier according to claim 3, wherein said user information is identical to said identification information in said short-range passive component.

5. The user identifier according to claim 1, wherein said long-range transmitter and said short-range passive component are mounted on an identification tag.

6. The user identifier according to claim 5, wherein said identification tag is attached to a wrist strap for securing said identification tag to a user's wrist.

7. A locator system for tracking the location of individuals in a defined environment, comprising:

at least one user identifier, comprising:

a long-range transmitter adapted to transmit an identification signal; and a short-range passive component having identification information;

at least one reader adapted to receive said identification signal from said long-range transmitter;

at least one locator station adapted to read said identification information from said short-range passive component; and an identification server adapted to communicate with said reader and said locator, said identification server having a database associating said identification signal of said long-range transmitter and said identification information of said short-range passive component with a particular user.

8. The locator system according to claim 7, further comprising a registration station adapted to receive user inputs and adapted to relay said inputs to said identification server.

9. The locator system according to claim 7, wherein said identification signal includes user information identifying said user.

10. The locator system according to claim 9, wherein said user information is identical to said identification information in said short-range passive component.

11. The locator system according to claim 7, wherein said at least one reader is adapted to calculate a user position based on receiving said identification signal.

12. The locator system according to claim 7, wherein said at least one reader is adapted to relay said identification signal to said identification server, and said identification server is adapted to calculate a user position based on receiving said identification signal.

* * * * *